United States Patent [19]

Bechstedt

[11] Patent Number: 4,539,123

[45] Date of Patent: Sep. 3, 1985

[54] PROCESS FOR PRODUCTION LIQUID FABRIC CONDITIONERS

[75] Inventor: Wolfgang Bechstedt, Langenfeld, Fed. Rep. of Germany

[73] Assignee: Henkel Kommanditgesellschaft auf Aktien, Duesseldorf, Fed. Rep. of Germany

[21] Appl. No.: 664,808

[22] Filed: Oct. 25, 1984

[30] Foreign Application Priority Data

Nov. 5, 1983 [DE] Fed. Rep. of Germany ..... 3340033

[51] Int. Cl.[3] ..... D06M 13/20; D06M 13/26

[52] U.S. Cl. ..... 252/8.8; 252/8.9; 252/174.16; 252/DIG. 1

[58] Field of Search ..... 252/8.8, 8.9, 136, 174.16, 252/180, DIG. 1

[56] References Cited

U.S. PATENT DOCUMENTS

| | | | |
|---|---|---|---|
| 3,563,901 | 2/1971 | Crotty | 252/136 |
| 4,098,814 | 7/1978 | Sommer et al. | 252/8.8 |
| 4,153,561 | 5/1979 | Hümüller et al. | 252/8.9 |
| 4,209,398 | 6/1980 | Ii et al. | 252/180 |
| 4,427,558 | 1/1984 | David | 252/8.8 |

FOREIGN PATENT DOCUMENTS

| | | |
|---|---|---|
| 1494847 | 12/1970 | Fed. Rep. of Germany . |
| 2841641 | 4/1980 | Fed. Rep. of Germany . |

*Primary Examiner*—Paul Lieberman
*Assistant Examiner*—Willie Thompson
*Attorney, Agent, or Firm*—Ernest G. Szoke; Henry E. Millson, Jr.; Mark A. Greenfield

[57] ABSTRACT

A process for producing a liquid fabric conditioner and the product thereof, comprising the steps of: dissolving maleic acid in prewarmed water; adding phosphoric acid; stirring the resulting solution while adding urea; and continuing stirring while adding at least one nonionic surfactant, to complete the process, and the product thereof.

20 Claims, No Drawings

PROCESS FOR PRODUCTION LIQUID FABRIC CONDITIONERS

BACKGROUND OF THE INVENTION

1. Field of the Invention

This invention relates to homogeneous, liquid conditioners for softening fabrics stiffened by washing in hard water, and a process for their manufacture.

2. Statement of the Related Art

In areas where the water is particularly hard, the underdosage of detergents in the washing of fabrics or the use of unsuitable detergents is known to produce deposits of dissolved minerals, especially lime, both on fabrics and also in the washing machines used. Under these conditions, the washed fabrics soon become gray and patchy and feel unpleasantly stiff. In order to overcome these disadvantages and to soften (delime) the stiffened fabrics, the fabrics are treated after washing in a rinsing cycle, for example with urea adducts of nitric acid or phosphoric acid, with amido-sulfonic acid, or with other acids. Unfortunately, this can give rise to extremely serious corrosion of the brass or copper parts of washing machines.

In German patent application No. 14 94 847, it is proposed to improve powdered, storable deliming preparations based on an adduct of urea and phosphoric acid by adding to them from 3 to 60% by weight of maleic acid anhydride. More rapid and complete dissolution of the incrustations, which normally consist of lime and rust, is said to be obtained in this way. From 0.1 to 3% by weight of cationic, anionic or nonionic surfactants may also be added to the preparations in question to improve their wetting power. The inclusion of corrosion inhibitors is also recommended although, in contrast to known acidic deliming preparations, the preparations in question have only a very slight corrosive effect and are stated to be kind to fibers. According to Example 1, 2% of coconut oil fatty alcohol sulfate was dissolved in a mixture of 40% by weight of (100%) phosphoric acid and 8% by weight of water and 10% by weight of powder-form maleic acid anhydride was added to the resulting solution. 27% by weight of urea was then added. After cooling and solidification of the mixture, 11% by weight of anhydrous sodium sulfate and 2% by weight of finely divided silica were added to improve the properties of the powder.

It has been found that the production of these effective deliming preparations on an industrial scale is too complicated and, therefore, too cost intensive. The production can only be carried out in factories equipped with the latest machinery, which unfortunately are not available to the required extent. In addition, consumers prefer liquid deliming preparations because they are easier to use in measured quantities.

Accordingly, it was obvious to try to overcome the inadequacies of the prior art by manufacturing and marketing the ingredients known from German patent application No. 14 94 847 in the form of aqueous solutions without the adsorbents, (sodium sulfate and finely divided silica), which are not required for liquid products. Unfortunately, this attempt resulted in an aqueous solution with a crystalline sediment for otherwise the same concentrations of the ingredients. Although a reduction in the phosphoric acid content to 40% by weight without any change in the concentrations of the other ingredients produced a clear solution, this clear solution separated into two phases and, on further reduction of the phosphoric acid content to 38% by weight, also became cloudy.

The replacement of maleic acid anhydride by pure maleic acid and of the anionic surfactant by 2 or 3% by weight of a nonyl phenol reacted with 10 moles of ethylene oxide initially resulted in clear solutions which were still stable after 2 days, even at room temperature, but which became solid and cloudy and could not be reliquefied after 24 hours in an alternating climate cell (−10° C./+40° C.).

Accordingly, it was found that the teachings of the prior art, which applied to a homogeneous powdered product, could not be readily applied to the required liquid products. The problem was solved by reformulating the compositions.

DESCRIPTION OF THE INVENTION

The present invention relates to a homogeneous, liquid fabric conditioner which is produced by a process wherein maleic acid is dissolved in warm water, phosphoric acid is added, urea is stirred into the solution and nonionic surfactants are then added with continued stirring.

Other than in the operating examples, or where otherwise indicated, all numbers expressing quantities of ingredients or reaction conditons used herein are to be understood as modified in all instances by the term "about".

More particularly, the present invention relates to a process for the production of a clear, homogeneous, liquid fabric conditioner in which: from 5 to 15 (preferably from 5 to 10) parts by weight of maleic acid is dissolved in from 20 to 50 (preferably in from 25 to 45) parts by weight of water preheated to 40°−60° C.; from 20 to 45 (preferably from 25 to 38) parts by weight of phosphoric acid (calculated as 100%) is added; from 10 to 25 (preferably from 15 to 23) parts by weight of urea is stirred into the solution; and, finally, from 1 to 10 (preferably from 1.5 to 8) parts by weight of a nonionic surfactant, (preferably a mixture of several nonionic surfactants), is added.

It could have been assumed that there would be no need to add urea for the production of liquid conditioners because, according to the prior art, the object of adding urea was to solidify the phosphoric acid through adduct formation. However; it has been found that urea contributes significantly towards the homogeneity of the liquid conditioners and acts as a corrosion inhibitor therein for brass and copper.

In a preferred optional embodiment, from 0.5 to 5 (preferably from 1.0 to 4.5) parts by weight of another anhydrous corrosion inhibitor, most preferably an alkyl monophosphonic acid containing from 6 to 10 (preferably from 8 to 10) carbon atoms in the molecule, may also be added to the conditioners according to the invention.

To make these corrosion inhibitors easier to incorporate, it is advisable to adopt the procedure proposed in German patent application No. 28 41 641 in which the alkyl monophosphonic acids are initially mixed with part of the nonionic surfactants and the resulting mixture incorporated in the solution after the addition of urea. The remainder of the surfactants may then be added with stirring.

Suitable nonionic surfactants include both alkyl phenols containing from 8 to 18 (preferably from 9 to 15) carbon atoms in the alkyl radical and also alkanols and alkenols containing from 12 to 22 (preferably from 12 to 18) carbon atoms, which have been ethoxylated with from 2 to 20 (preferably with from 5 to 10) mols of ethylene oxide, and mixtures thereof.

It may be advisable also to add solvents in the form of low molecular weight aliphatic alcohols, such as methanol, ethanol, isopropanol or butanol, and/or optionally solution promoters, such as low molecular weight alkyl benzene sulfonates, to the conditioners according to the invention in quantities of from 0.5 to 5 parts by weight.

EXAMPLES

The individual constituents of the conditoners produced by the process according to the invention are combined with one another in the manner indicated, the phosphoric acid being used in the form of commercially available concentrated 85% acid.

All the conditioners produced by the process according to the invention in the following examples were found to be thinly liquid, clear and homogeneous, even after 24 hours in an alternating climate cell at −10° C. to +40° C.

EXAMPLE 1

50.0 g of pure maleic acid were dissolved in 200 g of demineralized water preheated to 50° C. In sequence, 165 g of 85% phosphoric acid were then added, 62.5 g of urea were stirred into the solution, and, 17.5 g of an adduct of 10 mols of ethylene oxide with 1 mol of nonyl phenol and 5.0 g of an adduct of 6 mols of ethylene oxide with 1 mol of nonyl phenol were then added.

EXAMPLE 2

In this instance, 367.5 g of water, 69.0 g of maleic acid, 323.0 g of 85% phosphoric acid and 166.0 g of urea were stirred together at 40° C. in the same manner as described in Example 1, followed by the addition with continued stirring of a mixture of 15.0 g of octane phosphonic acid, 22.0 g of nonionic surfactants A and B and 7.5 g of isopropyl alcohol. Finally, 30.0 g of nonionic surfactant C were added. The nonionic surfactants used were as follows: 13.0 g of a mixture of equal parts of oleyl and cetyl alcohol reacted with 5 mols of ethylene oxide (surfactant A); 9.0 g of an adduct of 6 mols of ethylene oxide with 1 mol of nonyl phenol (surfactant B); 30.0 g of an adduct of 10 mols of ethylene oxide with 1 mol of nonyl phenol (surfactant C).

EXAMPLE 3

A conditioner having the following composition was prepared at 50° C. in the same manner as in Example 2:

- 9.0% by weight of maleic acid, pure,
- 37.4% by weight of phosphoric acid (calculated as 100%)
- 22.7% by weight of urea,
- 1.5% by weight of octane phosphonic acid,
- 1.3% by weight of a mixture of equal parts of oleyl and cetyl alcohol reacted with 5 mols of ethylene oxide,
- 0.9% by weight of an adduct of 6 mols of ethylene oxide with 1 mol of nonyl phenol,
- 0.9% by weight of methanol,
- 2.5% by weight of an adduct of 10 mols of ethylene oxide with 1 mol of nonyl phenol,
- 23.8% by weight of demineralized water.

EXAMPLE 4

A conditioner having the following composition was prepared at 60° C. in the same manner as in Example 2:

- 9.0% by weight of maleic acid, pure,
- 37.4% by weight of phosphoric acid (calculated as 100%)
- 22.7% by weight of urea,
- 1.5% by weight of octane phosphonic acid,
- 1.3% by weight of a mixture of equal parts of oleyl and cetyl alcohol reacted with 5 mols of ethylene oxide,
- 0.9% by weight of an adduct of 6 mols of ethylene oxide with 1 mol of nonyl phenol,
- 0.9% by weight of butanol,
- 3.5% by weight of an adduct of 10 mols of ethylene oxide with 1 mol of nonyl phenol,
- 22.8% by weight of demineralized water.

EXAMPLE 5

A conditioner having the following composition was prepared at 50° C. in the same manner as in Example 2:

- 8.7% by weight of maleic acid, pure,
- 33.9% by weight of phosphoric acid (calculated as 100%)
- 22.0% by weight of urea,
- 1.5% by weight of octane phosphonic acid,
- 1.3% by weight of a mixture of equal parts of oleyl and cetyl alcohol reacted with 5 mols of ethylene oxide,
- 0.9% by weight of an adduct of 6 mols of ethylene oxide with 1 mol of nonyl phenol,
- 0.9% by weight of isopropanol,
- 2.0% by weight of an adduct of 10 mols of ethylene oxide with 1 mol of nonyl phenol,
- 24.3% by weight of demineralized water.

EXAMPLE 6

A conditioner having the following composition was prepared at 50° C. in the same manner as in Example 2:

- 7.0% by weight of maleic acid, pure,
- 32.3% by weight of phosphoric acid (calculated as 100%)
- 16.6% by weight of urea,
- 1.5% by weight of octane phosphonic acid,
- 1.3% by weight of a mixture of equal parts of oleyl and cetyl alcohol reacted with 5 mols of ethylene oxide,
- 0.9% by weight of an adduct of 6 mols of ethylene oxide with 1 mol of nonyl phenol,
- 0.9% by weight of isopropanol,
- 1.0% by weight of an adduct of 10 mols of ethylene oxide with 1 mol of nonyl phenol,
- 38.5% by weight of demineralized water.

EXAMPLE 7

A conditioner having the following composition was prepared at 50° C. in the same manner as in Example 2:

- 7.0% by weight of maleic acid, pure,
- 32.3% by weight of phosphoric acid (calculated as 100%)
- 16.6% by weight of urea,
- 1.5% by weight of octane phosphonic acid,
- 1.3% by weight of a mixture of equal parts of oleyl and cetyl alcohol reacted with 5 mols of ethylene oxide,
- 0.9% by weight of an adduct of 6 mols of ethylene oxide with 1 mol of nonyl phenol, 0.9% by weight of isopropanol,
2.0% by weight of an adduct of 10 mols of ethylene oxide with 1 mol of nonyl phenol,
37.5% by weight of demineralized water.

EXAMPLE 8

A conditioner having the following composition was prepared at 50° C. in the same manner as in Example 2:

7.0% by weight of maleic acid, pure,
32.3% by weight of phosphoric acid (calculated as 100%)
16.6% by weight of urea,
1.5% by weight of octane phosphonic acid,
1.3% by weight of a mixture of equal parts of oleyl and cetyl alcohol reacted with 5 mols of ethylene oxide,
0.9% by weight of an adduct of 6 mols of ethylene oxide with 1 mol of nonyl phenol,
0.9% by weight of isopropanol,
3.0% by weight of an adduct of 10 mols of ethylene oxide with 1 mol of nonyl phenol,
36.5% by weight of demineralized water.

The compositions of Examples 1–8, as well as any other compositions according to this invention, may be utilized as fabric conditioners in any manner known in the art, adapted suitably to liquid conditioners.

I claim:

1. A process for the production of a homogeneous, liquid, fabric conditioner comprising the steps of:
dissolving maleic acid in prewarmed water;
adding phosphoric acid;
stirring the resulting solution while adding urea; and
continuing stirring while adding at least one nonionic surfactant to complete said conditioner production.

2. The process of claim 1 wherein: said maleic acid is added in a quantity of about 5 to 15 parts by weight and is dissolved in about 25 to 50 parts by weight of said water which is prewarmed to about 40 to 60° C.; said phosphoric acid (calculated as 100%) is added in a quantity of about 20 to 45 parts by weight; said urea is added in a quantity of about 10 to 25 parts by weight; and said at least one nonionic surfactant is added in about 1 to 10 parts by weight.

3. The process of claim 1 wherein: said maleic acid is added in a quantity of about 5 to 10 parts by weight and is dissolved in about 25 to 45 parts by weight of said water which is prewarmed to about 40 to 60° C.; said phosphoric acid (calculated as 100%) is added in a quantity of about 25 to 38 parts by weight; said urea is added in a quantity of about 15 to 23 parts by weight; and said at least one nonionic surfactant is added in about 1.5 to 8 parts by weight.

4. The process of claim 1 wherein said at least one nonionic surfactant is: at least one $C_{8-18}$-alkyl phenol ethoxylated with about 2 to 20 mols of ethylene oxide; at least one $C_{12-22}$-alkanol or -alkenol ethoxylated with about 2 to 20 mols of ethylene oxide; or any mixture of the foregoing.

5. The process of claim 1 wherein said at least one nonionic surfactant is: at least one $C_{9-15}$-alkyl phenol ethoxylated with about 5 to 10 mols of ethylene oxide; at least one $C_{12-18}$-alkanol or -alkenol ethoxylated with about 5 to 10 mols of ethylene oxide; or any mixture of the foregoing.

6. The process of claim 2 wherein said at least one nonionic surfactant is: at least one $C_{8-18}$-alkyl phenol ethoxylated with about 2 to 20 mols of ethylene oxide; at least one $C_{12-22}$-alkanol or -alkenol ethoxylated with about 2 to 20 mols of ethylene oxide; or any mixture of the foregoing.

7. The process of claim 3 wherein said at least one nonionic surfactant is: at least one $C_{8-18}$-alkyl phenol ethoxylated with about 2 to 20 mols of ethylene oxide; at least one $C_{12-22}$-alkanol or -alkenol ethoxylated with about 2 to 20 mols of ethylene oxide; or any mixture of the foregoing.

8. The process of claim 3 wherein said at least one nonionic surfactant is: at least one $C_{9-15}$-alkyl phenol ethoxylated with about 5 to 10 mols of ethylene oxide; at least one $C_{15-18}$-alkanol or -alkenol ethoxylated with about 5 to 10 mols of ethylene oxide; or any mixture of the foregoing.

9. The process of claim 1 with the additional non-sequential sequential step of adding a corrosion inhibitor in addition to said urea.

10. The process of claim 2 with the additional non-sequential step of adding about 0.5 to 5 parts by weight of a corrosion inhibitor in addition to said urea.

11. The process of claim 3 with the additional non-sequential step of adding about 1.0 to 4.5 parts by weight of a corrosion inhibitor in addition to said urea.

12. The process of claim 9 wherein said corrosion inhibitor is a $C_{6-10}$-alkyl monophosphonic acid.

13. The process of claim 10 wherein said corrosion inhibitor is a $C_{8-10}$-alkyl monophosphonic acid.

14. The process of claim 11 wherein said corrosion inhibitor is a $C_{8-10}$-alkyl monophosphonic acid.

15. The process of claim 1 wherein said corrosion inhibitor is first mixed with part of said at least one nonionic surfactant and the resulting mixture is incorporated in said process after the addition of said urea.

16. The process of claim 9 wherein said corrosion inhibitor is first mixed with part of said at least one nonionic surfactant and the resulting mixture is incorporated in said process after the addition of said urea.

17. The process of claim 11 wherein said corrosion inhibitor is first mixed with part of said at least one nonionic surfactant and the resulting mixture is incorporated in said process after the addition of said urea.

18. The process of claim 12 wherein said corrosion inhibitor is first mixed with part of said at least one nonionic surfactant and the resulting mixture is incorporated in said process after the addition of said urea.

19. The process of claim 13 wherein said corrosion inhibitor is first mixed with part of said at least one nonionic surfactant and the resulting mixture is incorporated in said process after the addition of said urea.

20. The process of claim 14 wherein said corrosion inhibitor is first mixed with part of said at least one nonionic surfactant and the resulting mixture is incorporated in said process after the addition of said urea.

* * * * *